US005582958A

United States Patent [19]

Buchanan et al.

[11] Patent Number: 5,582,958

[45] Date of Patent: Dec. 10, 1996

[54] PHOTOGRAPHIC BLEACHING COMPOSITION AND PROCESSING METHOD USING TERNARY IRON CARBOXYLATE COMPLEXES AS BLEACHING AGENTS

[75] Inventors: John M. Buchanan, Rochester; Eric R. Brown, Webster; Stuart T. Gordon, Pittsford, all of N.Y.

[73] Assignee: Eastman Kodak Company, Rochester, N.Y.

[21] Appl. No.: 370,997

[22] Filed: Jan. 10, 1995

[51] Int. Cl.[6] ..... G03C 7/00; G03C 5/38; G03C 5/42; G03C 5/44

[52] U.S. Cl. ..... 430/393; 430/461; 430/428; 430/430; 430/460

[58] Field of Search ..... 430/428, 451, 430/453, 460, 461, 393, 430

[56] References Cited

U.S. PATENT DOCUMENTS

| | | | |
|---|---|---|---|
| 4,268,618 | 5/1981 | Hashimura | 430/460 |
| 4,294,914 | 10/1981 | Fyson | 430/460 |
| 4,537,856 | 5/1989 | Kurematsu et al. | 430/372 |
| 4,963,474 | 10/1990 | Fujita et al. | 430/393 |
| 5,149,618 | 9/1992 | Tappe et al. | 430/393 |
| 5,238,791 | 8/1993 | Tappe et al. | 430/393 |
| 5,250,401 | 10/1993 | Okada et al. | 430/393 |
| 5,250,402 | 10/1993 | Okada et al. | 430/460 |
| 5,300,408 | 4/1994 | Okada et al. | 430/460 |
| 5,460,924 | 10/1995 | Buchanan et al. | 430/393 |

FOREIGN PATENT DOCUMENTS

| | | | |
|---|---|---|---|
| 0199604 | 10/1986 | European Pat. Off. | 430/460 |
| 0270217 | 6/1988 | European Pat. Off. | 430/460 |
| 0329088A3 | 8/1989 | European Pat. Off. . | |
| 0534086A1 | 3/1993 | European Pat. Off. . | |
| 0532003 | 3/1993 | European Pat. Off. | 430/461 |
| 0553569A1 | 8/1993 | European Pat. Off. . | |
| 0567126A1 | 10/1993 | European Pat. Off. . | |
| 0602600A2 | 6/1994 | European Pat. Off. . | |
| 3919551A1 | 6/1989 | Germany . | |
| 3939755A1 | 12/1989 | Germany . | |
| 4226372A1 | 8/1992 | Germany . | |
| 50-26542 | 3/1975 | Japan . | |
| 51-007930 | 1/1976 | Japan . | |
| 53-048527 | 5/1978 | Japan . | |
| 63-95452 | 4/1988 | Japan | 430/460 |
| 5-72695 | 3/1993 | Japan | 430/461 |
| 5-281684 | 10/1993 | Japan | 430/460 |
| 6-123950 | 5/1994 | Japan | 430/460 |

*Primary Examiner*—Charles L. Bowers, Jr.
*Assistant Examiner*—J. Pasterczyk
*Attorney, Agent, or Firm*—J. Lanny Tucker

[57] ABSTRACT

A photographic bleaching or bleach/fixing composition contains a water-soluble ternary complex of an iron ion, a polycarboxylate ligand, and a second ligand which has at least one carboxyl group on an aromatic nitrogen heterocycle, such as a pyridinecarboxylic acid. Preferred materials are biodegradable, but all of the ternary complexes can be used in a variety of bleach or bleach/fix processes to good advantage as bleaching agents. They are particularly suitable for use in rehalogenating ferric chelate bleaches.

24 Claims, 2 Drawing Sheets

PHOTOGRAPHIC BLEACHING COMPOSITION AND PROCESSING METHOD USING TERNARY IRON CARBOXYLATE COMPLEXES AS BLEACHING AGENTS

FIELD OF THE INVENTION

The present invention relates to a photographic bleaching or bleach/fixing composition, and to a method for its use to process imagewise exposed and developed color photographic elements.

BACKGROUND OF THE INVENTION

During processing of silver halide color photographic elements, the developed silver is oxidized to a silver salt by a suitable bleaching agent. The oxidized silver is then removed from the element in a "fixing" step. In some processes, the two steps can be combined in a so-called bleach-fix step.

Common bleaching agents include ferric chelate complexes of aminopolycarboxylate ligands, such as ethylenediaminetetraacetic acid (EDTA) and 1,3-propylenediaminetetraacetic acid (PDTA). These agents perform acceptably, but are not generally biodegradable, and environmental concerns are very prominent in many cultures.

Other bleaching agents are known which have one or more deficiencies. For example, ferric complexes of β-alaninediacetic acid are known, but they are relatively slow bleaching agents compared to the ferric-EDTA complexes. Thus, they must be used in higher concentrations which is undesirable for cost and environmental reasons.

Japanese Kokai 51-07930 (published Jan. 22, 1976) describes the use of nitrilotriacetic acid or 2,6-pyridinedicarboxylic acid or both to reduce stains in neutralizing or fixing solutions. Bleaching solutions containing an aminocarboxylic acid metal complex salt or a polycarboxylic acid metal complex salt are also known. Japanese Kokai 53-048527 (published May 2, 1978) describes the use of such complexes to lower fog.

EP-A-0 329 088 (published Aug. 23, 1989) describes bidentate complexes in bleaching solutions which further contain buffers, one of which is 2-pyridinecarboxylic acid (PCA). Complexes of PCA with iron are not described.

Other biodegradable bleaching agents, such as ferric citrate, are effective only at very low pH, such as below pH 3 (see for example, DE 3,919,551A1). Another example of a biodegradable bleaching agent is the ferric complex of 2,6-pyridinedicarboxylic acid (PDCA). This complex has been demonstrated as an efficient catalyst for persulfate bleaching, as described in copending and commonly assigned U.S. Ser. No. 07/990,500 (filed Dec. 14, 1992 by Buchanan et al now abandoned). However, the ferric complex is insufficiently water-soluble to be used at the concentrations required for a commercially viable bleach in which the ferric complex is the primary oxidant.

Bleaching solutions have been developed which contain more than one ligand and which help provide rapid bleaching without unwanted dye formation in color photographic materials. However, such solutions contain two distinct iron-complex salts. For example, in KODAK FLEXICOLOR™ Bleach II, one salt is ferric ammonium-EDTA, and the other is ferric ammonium-PDTA. While such mixtures are stable and provide excellent bleaching, neither of the noted complexes is readily biodegradable. Other mixtures of complexes are described in EP-A-0 430 000, but they lack stability when used in combination with thiosulfate fixing agents. Other ligand mixtures are described in EP-A-0 534 086 wherein bidentate ligands are used as buffering agents.

Useful ternary bleaching agents are described in copending and commonly assigned U.S. Ser. No. 08/128,626 (filed Sep. 28, 1993 by Gordon et al pending). Such materials comprise one iron atom and two different ligands. While these materials are useful in some processes, there continues to be a need for more rapid processes using biodegradable materials.

Japanese Kokai 50-26542 (published Mar. 19, 1975) describes bleaching solutions containing an iron chelate with one or more ligands such as 2-carboxypyridine, 8-hydroxyquinoline or 2-carboxypyrazine. However, the mol ratios of these ligands to iron are quite low as demonstrated in the examples of that publication. Such ratios fail to provide the rapid and superior bleaching performance desired in the industry.

There remains a need in the art for highly water-soluble bleaching agents which preferably comprise biodegradable ligands, provide rapid bleaching and are compatible with chloride rehalogenation.

SUMMARY OF THE INVENTION

The problems noted above have been solved with a composition for bleaching or bleach/fixing an imagewise exposed and developed silver halide color photographic element comprising, as a bleaching agent, a ternary complex formed from:

a) an iron salt, b) a polycarboxylate or aminocarboxylate ligand, and c) a carboxylate ligand containing an aromatic nitrogen heterocycle, wherein the mol ratio of b) ligand to iron in the complex is at least 1:1, and the mol ratio of c) ligand to iron in the complex is at least 0.6:1, the composition having a pH of from about 3 to about 7 provided by an acidic compound other than any of a), b) and c), and the composition being free of a peracid bleaching agent.

The invention also provides a photographic bleaching or bleach/fixing method comprising processing an imagewise exposed and developed silver halide color photographic element with the bleaching or bleach/fixing composition described above.

The photographic processing composition of this invention provides strong and rapid bleaching. Moreover, the preferred bleaching agents are highly water-soluble and biodegradable.

A very surprising advantage of our invention is that the bleaching agents of this invention allow the reduction of bromide concentration or the substitution of chloride for bromide as a rehalogenating agent with remarkably little or no loss in bleaching rate. Rehalogenation of silver metal to silver chloride is desirable because silver chloride is more easily fixed out of the emulsion coating than is silver bromide. Thus, the present invention is suitable for use as rehalogenating ferric chelate bleaching solutions containing a suitable rehalogenating agent, and particularly chloride rehalogenating agent. The use of chloride is particularly preferred for processing photographic elements in which more than 50% of the coated silver is in the form of silver chloride.

These advantages have been achieved using as bleaching agents certain ternary iron complexes formed from selected combinations of carboxylate ligands. A first ligand is a polycarboxylate or aminopolycarboxylate, and a second ligand is a carboxylate containing a nitrogen heterocycle. Moreover, the mol ratios of the specific ligands to the iron are critical for achieving superior bleaching, and for avoiding rust formation and water-insolubility. Thus, the mol ratio of the first ligand to iron is at least 1:1, and the mol ratio of the second ligand to iron is at least 0.6:1. More specific ratios may be useful for bleaching solutions containing fixing agents or rehalogenating agents.

It is apparent from the experimentation done with the present invention that one skilled in the art cannot reasonably predict the formation of ternary complexes merely by mixing various known ligands with iron salts. In many cases, a mixture of binary complexes is formed, which is not the present invention. In other cases, ferric ion is complexed by only one of the two ligands present, which is also not the present invention. With the materials described herein, however, true ternary complexes are formed.

DETAILED DESCRIPTION OF THE INVENTION

Figure 1:
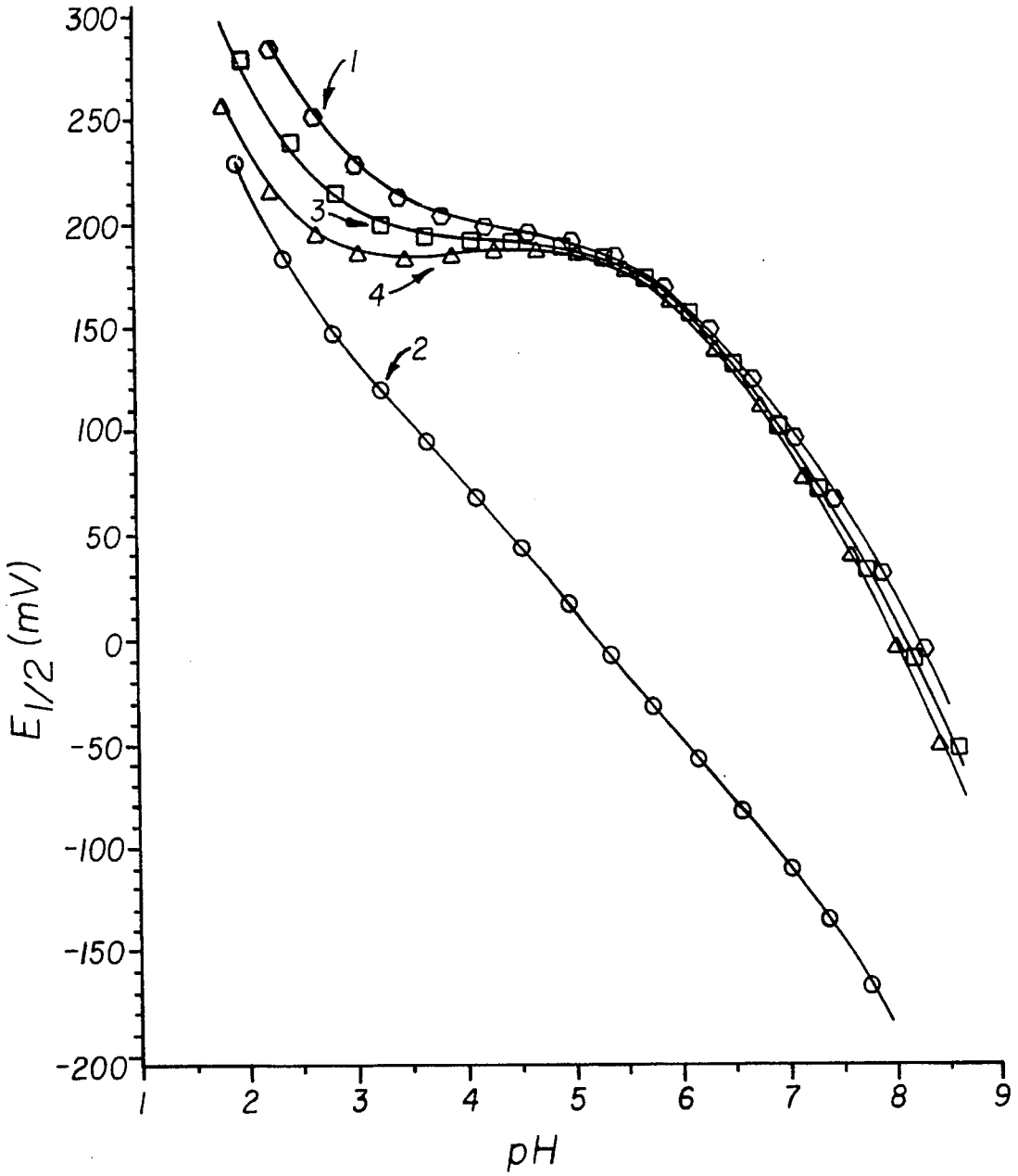
FIGS. 1 and 2 are graphical plots of redox potential vs. pH for various ternary and binary complexes as described in Example 1 below.

The composition of this invention includes one or more ternary iron complexes, each complex being composed of iron and one or more ligands from each of two distinctly different classes of ligands which are defined below. Thus, the ternary complex used in this invention is the complex formed from an iron salt with two distinctly different ligand structures.

The formation of a ternary complex from a metal ion and two different chelating compounds can be measured by direct pH titration methods as described, for example, by Irving et al in *J. Chem. Soc.*, 2904 (1954). Alternatively, spectral methods can be used if the complexes have sufficiently different absorption spectra from the individual ligands or the uncomplexed metal ion salt.

Potentiometric measurements of the type described by Bond et al in *J. Faraday Soc.*, 55, 1310 (1959) can also be used to study ternary complexation. Potentials are measured in a solution containing equal concentrations of ferric-ion salt and ferrous-ion salt to which are added different amounts of each of the two chelating ligands of interest. This method is demonstrated in Example 1 below.

The iron salts used as bleaching agents in the practice of this invention are generally ferric ion salts which provide a suitable amount of ferric ion for complexation with the ligands defined below. Useful ferric salts include, but are not limited to, ferric nitrate nonahydrate, ferric ammonium sulfate, ferric oxide, ferric sulfate and ferric chloride. Ferric nitrate nonahydrate is preferred. These salts can be provided in any suitable form and are available from a number of commercial sources.

Alternatively, ferric salts can be generated from the corresponding ferrous ion salts, such as ferrous sulfate, ferrous oxide, ferrous ammonium sulfate and ferrous chloride. Generating the desired ferric ions requires an additional step of oxidation of the ferrous ion by a suitable means, such as by bubbling air or oxygen through a ferrous ion solution.

The first class of ligands used in this invention are polycarboxylate or aminocarboxylate ligands which are well known in the art and include compounds having at least two carboxyl groups (polydentate), or their corresponding salts. Such ligands can be bidendate, tridentate, tetradentate, pentadentate and hexadentate ligands, referring to the number of sites available to bind to ferric ion. These ligands must be water-soluble also, and are preferably biodegradable (defined below). These ligands are identified as "b) ligands" hereinafter.

More specifically, b) ligands include, but are not limited to, hydroxycarboxylic acids, alkylenediaminetetracarboxylic acids having a tertiary nitrogen atom, alkylenediaminepolycarboxylic acids having a secondary nitrogen atom, iminopolyacetic acids, substituted ethyliminopolycarboxylic acids, aminopolycarboxylic acids having an aliphatic dibasic acid group and amino ligands having an aromatic or heterocyclic substituent.

Representative useful classes of b) ligands are defined below in reference to structures (I)–(VII), although it should be recognized that the invention is not limited in practice to these ligands.

Thus, useful b) ligands can be compounds having any of the following structures:

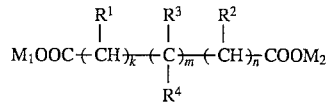

(I)

wherein $R^1$ and $R^2$ are independently hydrogen or hydroxy, $R^3$ and $R^4$ are independently hydrogen, hydroxy or carboxy (or a corresponding salt), $M_1$ and $M_2$ are independently hydrogen or a monovalent cation (such as ammonium, sodium, potassium or lithium), k, m and n are 0 or 1, provided that at least one of k, m and n is 1, and further provided that compound (I) has at least one hydroxy group,

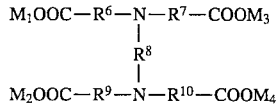

(II)

wherein $R^6$, $R^7$, $R^8$, $R^9$ and $R^{10}$ are independently a linear or branched substituted or unsubstituted alkylene group of 1 to 8 carbon atoms (such as methylene, ethylene, trimethylene, hexamethylene, 2-methyltrimethylene and 4-ethylhexamethylene), and $M_1$, $M_2$, $M_3$ and $M_4$ are independently hydrogen or a monovalent cation, as defined above for $M_1$ and $M_2$,

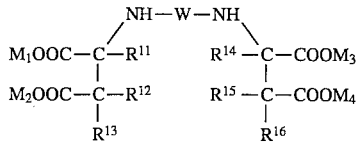

(III)

wherein $R^{11}$, $R^{12}$, $R^{13}$, $R^{14}$, $R^{15}$ and $R^{16}$ are independently hydrogen, hydroxy, a linear or branched substituted or unsubstituted alkyl group of 1 to 5 carbon atoms (such as methyl, ethyl, propyl, isopropyl, n-pentyl, t-butyl and 2-ethylpropyl), a substituted or unsubstituted cycloalkyl group of 5 to 10 carbon atoms in the ring (such as cyclopentyl, cyclohexyl, cycloheptyl and 2,6-dimethylcyclohexyl), or a substituted or unsubstituted aryl group having 6 to 10 carbon atoms in the aromatic nucleus (such as phenyl, naphthyl, tolyl and xylyl), $M_1$, $M_2$, $M_3$ and $M_4$ are as defined above, and W is a covalent bond or a divalent substituted or unsubstituted aliphatic linking group (defined below),

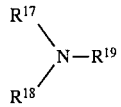

(IV)

wherein at least two of $R^{17}$, $R^{18}$ and $R^{19}$ are a carboxymethyl (or equivalent salts), and the third group is hydrogen, a substituted or unsubstituted alkyl group of 1 to 5 carbon atoms (as defined above), a substituted or unsubstituted hydroxyethyl or unsubstituted carboxymethyl (or equivalent salts),

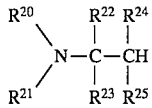

(V)

wherein $R^{20}$ and $R^{21}$ are independently substituted or unsubstituted carboxymethyl (or equivalent salts) or 2-carboxyethyl (or equivalent salts), and $R^{22}$, $R^{23}$, $R^{24}$ and $R^{25}$ are independently hydrogen, a substituted or unsubstituted alkyl group of 1 to 5 carbon atoms (as defined above), hydroxy, carboxy or substituted or unsubstituted carboxymethyl (or equivalent salts), provided that only one of $R^{22}$, $R^{23}$, $R^{24}$ and $R^{25}$ is carboxy or substituted or unsubstituted carboxymethyl (or equivalent salts),

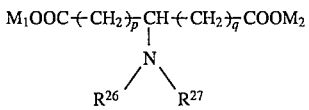

(VI)

wherein $R^{26}$ and $R^{27}$ are independently hydrogen, a substituted or unsubstituted alkyl group of 1 to 5 carbon atoms (as defined above), substituted or unsubstituted hydroxyethyl, substituted or unsubstituted carboxymethyl or 2-carboxyethyl (or equivalent salts), $M_1$ and $M_2$ are as defined above, and p and q are independently 0, 1 or 2 provided that the sum of p and q does not exceed 2, or

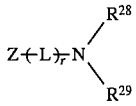

(VII)

wherein

Z represents a substituted or unsubstituted aryl group of 6 to 10 carbon atoms in the nucleus (as defined above) or a substituted or unsubstituted heterocycle having 5 to 7 carbon, nitrogen, sulfur and oxygen atoms in the nucleus (such as furanyl, thiofuranyl, pyrrolyl, pyrazolyl, triazolyl, dithiolyl, thiazolyl, oxazoyl, pyranyl, pyridyl, piperidinyl, pyrazinyl, triazinyl, oxazinyl, azepinyl, oxepinyl and thiapinyl), L is a divalent substituted or unsubstituted aliphatic linking group (defined below), $R^{28}$ and $R^{29}$ are independently hydrogen, a substituted or unsubstituted alkyl group of 1 to 5 carbon atoms (as defined above), a substituted or unsubstituted carboxyalkyl group of 2 to 4 carbon atoms (such as substituted or unsubstituted carboxymethyl or carboxyethyl or equivalent salts) or a hydroxy-substituted carboxyalkyl group of 2 to 4 carbon atoms (or equivalent salts), and r is 0 or 1.

The "divalent substituted or unsubstituted aliphatic linking group" in the definition of "W" and "L" noted above includes any nonaromatic linking group comprised of one or more alkylene, cycloalkylene, oxy, thio, amino or carbonyl groups which form a chain of from 1 to 6 atoms. Examples of such groups include, but are not limited to, alkylene, alkyleneoxyalkylene, alkylenecycloalkylene, alkylenethioalkylene, alkyleneaminoalkylene, alkylenecarbonyloxyalkylene, all of which can be substituted or unsubstituted, linear or branched, and others which would be readily apparent to one skilled in the art.

In defining the "substituted or unsubstituted" monovalent and divalent groups for the structures noted above, by "substituted" is meant the presence of one or more substituents on the group, such as an alkyl group of 1 to 5 carbon atoms (linear or branched), hydroxy, sulfo, carbonamido, sulfonamido, sulfamoyl, sulfonato, thioalkyl, alkylcarbonamido, alkylcarbamoyl, alkylsulfonamido, alkylsulfamoyl carboxyl, amino, halo (such as chloro or bromo), sulfono (—$SO_2R$) or sulfoxo [—S(O)R] wherein R is a branched or linear alkyl group of 1 to 5 carbon atoms.

In reference to the foregoing structures (I)–(VII), preferred definitions of groups are as follows:

$R^1$ and $R^2$ are independently hydrogen or hydroxy, $R^3$ and $R^4$ are independently hydroxy or carboxy, provided at least one hydroxy group is in compound (I), $R^6$, $R^7$, $R^8$, $R^9$ and $R^{10}$ are independently alkylene of 1 to 3 carbon atoms, $M_1$, $M_2$, $M_3$ and $M_4$ are independently hydrogen, ammonium, sodium or potassium, $R^{11}$, $R^{12}$, $R^{13}$, $R^{14}$, $R^{15}$ and $R^{16}$ are independently hydrogen, hydroxy or methyl, W is a covalent bond or a substituted or unsubstituted alkylene group of 1 to 3 carbon atoms, at least two of $R^{17}$, $R^{18}$ and $R^{19}$ are carboxymethyl and the third group is hydrogen, methyl, carboxymethyl or carboxyethyl, $R^{20}$ and $R^{21}$ are each carboxymethyl, $R^{22}$, $R^{23}$, $R^{24}$ and $R^{25}$ are independently hydrogen, carboxymethyl or carboxy, $R^{26}$ and $R^{27}$ are independently hydrogen, methyl or carboxymethyl, Z represents 2-pyridyl or 2-imidazolyl, L is substituted or unsubstituted alkylene of 1 to 3 carbon atoms, $R^{28}$ and $R^{29}$ are independently hydrogen, 2-carboxyethyl or carboxymethyl, and r is 1.

Ligands having structure I, III or IV are preferred. More preferred b) ligands are citric acid, tartaric acid, iminodiacetic acid, methyliminodiacetic acid, nitrilotriacetic acid, β-alaninediacetic acid, alaninediacetic acid, ethylenediaminedisuccinic acid, ethylenediaminediacetic acid, alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid and 2-pyridylmethyliminodiacetic acid. Certain biodegradable ligands (such as citric acid, nitrilotriacetic acid, β-alaninediacetic acid and ethylenediaminedisuccinic acid) in this list are most preferred. Of those, citric acid is the b) ligand of choice.

Besides those ligands specifically defined in the foregoing description, there is considerable literature which describes additional useful ligands, such as EPA 0 567 126 (Seki et al), U.S. Pat. No. 5,250,401 (Okada et al) and U.S. Pat. No. 5,250,402 (Okada et al).

Many of these materials are commercially available or can be prepared by methods known to those skilled in the art.

A second class of carboxylate ligands is used to provide the ternary complex in the practice of this invention. Such compounds generally comprise at least one carboxyl group and an aromatic nitrogen hetrocycle. They are water-soluble and preferably biodegradable. Hereinafter, such ligands are identified as "c) ligands".

More specifically, c) ligands include substituted or unsubstituted 2-pyridinecarboxylic acids and substituted or unsubstituted 2,6-pyridinedicarboxylic acids (or equivalent salts). The substituents which may be on the pyridinyl ring include substituted or substituted alkyl, substituted or unsubstituted cycloalkyl or substituted or unsubstituted aryl groups (as defined above for structures I–VII), hydroxy, nitro, sulfo, amino, carboxy, sulfamoyl, sulfonamide, phospho, halo or any other group that does not interfere with ferric ion ternary complex formation, stability, solubility or catalytic activity. The substituents can also be the atoms necessary to form a 5- to 7-membered fused ring between any of the positions of the pyridinyl nucleus.

The preferred c) ligands of this type are represented by the following structures:

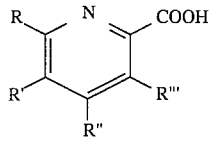

(VIII)

and

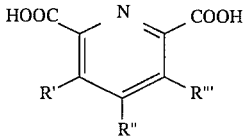

(IX)

wherein R, R', R" and R'" are independently hydrogen, a substituted or unsubstituted alkyl group of 1 to 5 carbon atoms (as defined above), a substituted or unsubstituted aryl group of 6 to 10 carbon atoms (as defined above), a substituted or unsubstituted cycloalkyl group of 5 to 10 carbon atoms (as defined above), hydroxy, nitro, sulfo, amino, carboxy, sulfamoyl, sulfonamido, phospho or halo (such as chloro or bromo ), or any two of R, R', R" and R'" can comprise the carbon atoms necessary to form a substituted or unsubstituted 5 to 7-membered ring fused with the pyridinyl nucleus.

The monovalent and divalent radicals defining Structures VIII and IX can have substituents like those defining the radicals for Structures I–VII above.

Preferably, R, R', R" and R'" are independently hydrogen, hydroxy or carboxy. The most preferred compounds are unsubstituted 2-pyridinecarboxylic acid and 2,6-pyridinedicarboxylic acid.

It should be understood that salts of these compounds are equally useful. Useful c) ligands are also described in various publications, including Japanese Kokai 51-07930 (noted above), EP-A-0 329 088 (noted above) and *J. Chem. Soc. Dalton Trans.*, 619 (1986).

The c) ligands can be obtained from a number of commercial sources or prepared using conventional procedures and starting materials (see for example, Syper et al, *Tetrahedron*, 36, 123–129, 1980 and Bradshaw et al, *J. Am. Chem. Soc.*, 102(2), 467–74, 1980).

The ternary complexes useful in this invention can be prepared and isolated as salts (such as ammonium or alkali metal salts), or they can be synthesized in situ as part of the preparation of the composition of this invention. Also, as noted above, the ferric complexes can be generated from the corresponding ferrous complexes which are then subjected to oxidation conditions. In the preparation of the complexes, the ligands and iron salt can be mixed together simultaneously or various components can be added in a suitable sequence. Preferably, the c) ligand is added to the reaction mixture after the iron salt and b) ligand.

As used herein, the terms "biodegradable" or "biodegradability" refer to at least 80% decomposition in the standard test protocol specified in by the Organization for Economic Cooperation and Development (OECD), Test Guideline 302B (Paris, 1981), also known as the "Modified Zahn-Wellens Test".

The concentration of ferric ion in the ternary complexes is generally at least 0.0005 mol/l. The specific amount for optimum effect will vary depending upon the specific ligands used and the specific use of the complex. For example, the concentration of the complex when used as a bleaching agent in a rehalogenating bath may be different than when the complex is used in a bleach-fixing bath. The amount of iron salt needed to obtain the desired amount of ferric ion in the complex would be readily apparent to one skilled in the art.

In the most general sense, the concentration of ferric ion is from about 0.005 to about 1 mol/l, with from about 0.005 to about 0.5 mol/l being preferred. The amount of ferric ion is preferably from about 0.01 to about 0.5 mol/l, with more preferred amounts being from about 0.02 to about 0.2 mol/l. In bleach/fixing compositions, the preferred amount of ferric ion is from about 0.01 to about 0.3 mol/l, with more preferred amounts being from about 0.02 to about 0.15 mol/l.

The mol ratio of b) ligand to ferric ion in the ternary complex is at least 1:1, but the preferred amounts of b) ligand can vary depending upon the specific ligand used and the use of the complex. More generally, the mol ratio is from 1:1 to 5:1, but preferred ratios are from 1:1 to 3.5:1. At mol ratios less than 1:1, rust formation and staining are more likely, and there is a greater tendency for the formation of water-insoluble salts.

The mol ratio of the c) ligand is at least 0.6:1. As with the other components of the complex, the optimum amount will vary depending upon the specific ligand used and the specific use of the complex. A more general mol ratio is from 0.6:1 to 4:1. As demonstrated in Example 22 below, at a mol ratio of less than 0.6:1, inferior bleaching or bleach/fixing results. At mol ratios significantly higher than 4:1, undesirable water-insoluble salts of ferric ion and c) ligand may form.

The amount of complex can be determined in a more functional manner by defining it as the amount needed to bleach at least 90% of the developed silver metal in a given imagewise exposed and developed silver halide color photographic element in a reasonable processing time, for example less than about 3 minutes. For some elements, such as photographic papers, this bleaching efficiency will be reached in much shorter times, whereas other elements, such as color negative films, will require longer times, for example up to 6.5 minutes. One skilled in the art could readily determine the appropriate amount of ternary complex to be used in the composition for a given type of photographic element with routine experimentation.

The pH value of the composition of the present invention helps establish formation of the ternary complex and aids in stability of various optional reagents, such as fixing agents. The pH is preferably in the range of from about 2 to about 8, and most preferably in the range of from about 3 to about 7.

In order to adjust and control the pH, the composition includes one or more organic acidic compounds other than the compounds used to form the ternary complex. Such compounds are typically weak acids having a $pK_a$ between about 1.5 and about 7. Preferably, such acids are carboxylic acids having one or more carboxyl groups and a $pK_a$ of from about 2.5 to about 7. The amount of acid used is generally at least about 0.05 mol/l, and more preferably from about 0.1 to about 3 mol/l.

Useful acidic compounds include, but are not limited to, monobasic acids (such as acetic acid, propionic acid, glycolic acid, benzoic acid and sulfobenzoic acid), amino acids (such as asparagine, aspartic acid, glutamic acid, alanine, arginine, glycine, serine and leucine), dibasic acids (such as oxalic acid, malonic acid, succinic acid, glutaric acid, tartaric acid, fumaric acid, maleic acid, malic acid, oxaloacetic acid, phthalic acid, 4-sulfophthalic acid, 5-sulfoisophthalic acid and sulfosuccinic acid), tribasic acids (such as citric acid), and ammonium or alkali metal salts of any of the foregoing acids. Examples of preferred acids are acetic acid, glycolic acid, maleic acid, succinic acid, sulfosuccinic acid, 5-sulfoisophthalic acid and 4-sulfophthalic acid.

In one embodiment, the composition of this invention is used for bleach/fixing, and it contains one or more fixing agents, such as thiosulfates, thiocyanates, thioethers, amines, mercapto-containing compounds, thiones, thioureas, iodides and others which would be readily apparent to one skilled in the art. Particularly useful fixing agents include, but are not limited to, ammonium thiosulfate, sodium thiosulfate, potassium thiosulfate and guanidine thiosulfate, with ammonium thiosulfate being particularly preferred for rapid fixing. Useful and optimum amounts of fixing agents would be readily apparent to one skilled in the art, and are generally from about 0.1 to about 3.0 mol/l.

The bleach-fixing composition may also contain a preservative such as sulfite, for example, ammonium sulfite, a bisulfite, or a metabisulfite salt, or bleaching and fixing accelerators.

The ternary complexes described herein are used as bleaching agents. Thus, the compositions do not contain peracid (persulfate or peroxide) bleaching agents. Details of bleaching compositions (other components, pH and other features) are well known and described, for example, in *Research Disclosure,* publication 365, September, 1994. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

In a preferred embodiment of this invention, the bleaching composition of this invention comprises one or more rehalogenating agents, such as a halide (for example, chloride, bromide or iodide). Chloride ion is preferably used as a rehalogenating agent even though before the present invention, it was not possible to use chloride rehalogenation with iron chelate bleach solutions. In the presence of the ternary ferric complexes described herein, bromide ion can be reduced in concentration or replaced with chloride ion without loss in strong bleaching capability. Generally, the amount of rehalogenating agent is from about 0.05 to about 2 mol/l with from about 0.1 to about 0.5 mol/l being preferred. The counterion used for the rehalogenating agent can be any acceptable cation such as ammonium, alkali metal or alkaline earth ions. Ammonium is preferred for bleaching efficiency and water solubility, but sodium and potassium may be more environmentally desirable.

The composition of this invention can also be what is known in the art as a silver-retentive bleaching composition and contain an organic silver salt instead of a halide rehalogenating agent, as described for example, in U.S. Pat. No. 4,454,224 (Brien et al).

As used herein in defining concentrations of reagents, the term "about" refers to ±20% of the indicated amount. In defining pH or pKa values, the term "about" refers to ±0.5 unit.

The composition of this invention can optionally contain one or more addenda commonly included in bleaching or bleach/fixing compositions, such as bleach accelerators, corrosion inhibitors, optical whitening agents, defoaming agents, calcium sequestrants and chlorine scavengers. The compositions can be formulated as a working bleaching or bleach/fixing solutions, solution concentrates or as dry powders or tablets.

A preferred embodiment of this invention comprises a composition for bleaching or bleach/fixing an imagewise exposed and developed silver halide photographic element comprising:

1) as a bleaching solution, a ternary complex formed from:
   a) an iron salt,
   b) citric acid or a salt thereof, and
   c) 2-pyridinecarboxylic acid or 2,6-pyridinecarboxylic acid, wherein the mol ratio of b) ligand to iron in the complex is from 1:1 to 3.5:1, and the mol ratio of c) ligand to iron in the complex is from 0.6:1 to 4:1, 2) acetic acid or glycolic acid buffer, and
3) one or more of the components selected from the group consisting of:
   a rehalogenating agent,
   a fixing agent,
   a defoaming agent,
   a chlorine scavenger,
   a bleach accelerator,
   a calcium sequestrant,
   a corrosion inhibitor, and
   an optical whitening agent, the composition being free of a peracid bleaching agent.

The photographic elements to be processed using the present invention can contain any of the conventional silver halides as the photosensitive material, for example, silver chloride, silver bromide, silver bromoiodide, silver chlorobromide, silver chloroiodide, and mixtures thereof. Preferably, however, the photographic element is a high chloride element, containing at least 50 mole % silver chloride and more preferably at least 90 mole % silver chloride.

The photographic elements processed in the practice of this invention can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. The element can contain additional layers such as filter layers, interlayers, overcoat layers, subbing layers and the like as is well known in the art. The element may also contain a magnetic backing such as is also known in the art.

Considerably more details of photographic elements of many varieties are provided in the "*Research Disclosure*"

publication noted above, which is incorporated herein by reference. Such details relate, for example, to useful silver halide emulsions (either negative-working or positive-working) and their preparation, color-forming couplers, color developing agents and solutions, brighteners, antifoggants, image dye stabilizers, hardeners, plasticizers, lubricants, matting agents, paper and film supports, and the various image-formation processes for both negative-image and positive-image forming color elements. Other suitable emulsions are (111) tabular silver chloride emulsions such as described in U.S. Pat. No. 5,176,991 (Jones et al), U.S. Pat. No. 5,176,992 (Maskasky et al), U.S. Pat. No. 5,178,997 (Maskasky), U.S. Pat. No. 5,178,998 (Maskasky et al), U.S. Pat. No. 5,183,732 (Maskasky), U.S. Pat. No. 5,185,239 (Maskasky), U.S. Pat. No. 5,292,632 (Maskasky), U.S. Pat. No. 5,314,798 (Brust) and U.S. Pat. No. 5,320,938 (House et al).

Photographic elements can be exposed to actinic radiation, typically in the visible region of the spectrum, to form a latent image using known methods and then processed to form a visible dye image. Processing includes the step of contacting the element with a color developing agent to reduce developable silver halide and to oxidize the color developing agent. Oxidized color developing agent in turn reacts with the coupler to yield a dye.

Photographic color developing compositions are employed in the form of aqueous alkaline working solutions having a pH of above 7 and most typically in the range of from about 9 to about 13.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching and fixing, or bleach/fixing to remove silver and silver halide, washing and drying.

In some cases, a separate pH lowering solution, referred to as a stop bath, is employed to terminate development prior to bleaching. A stabilizer bath is commonly employed for final washing and hardening of the bleached and fixed photographic element prior to drying.

Preferred processing sequences for color photographic elements, particularly color negative films and color print papers, include, but are not limited to, the following:

(P-1) Color development/Stop/Bleaching-fixing/Washing/Stabilizing/Drying.

(P-2) Color development/Stop/Bleaching-fixing/Stabilizing/Drying.

(P-3) Color development/Bleaching-fixing/Washing/Stabilizing/Drying.

(P-4) Color development/Bleaching-fixing/Washing.

(P-5) Color development/Bleaching-fixing/Stabilizing/Drying.

(P-6) Color development/Stop/Washing/Bleaching-fixing/Washing/Drying.

(P-7) Color development/Bleaching/Fixing/Stabilizing.

(P-8) Color development/Bleaching/Washing/Fixing/Washing/Stabilizing.

(P-9) Color development/Bleaching/Bleach-fixing/Fixing/Stabilizing.

In each of processes (P-1) to (P-9), variations are contemplated. For example,-a bath can be employed prior to color development, such as a prehardening bath, or the washing step may follow the stabilizing step. Additionally, reversal processes which have the additional steps of black and white development, chemical fogging bath, light re-exposure, and washing before the color development are contemplated.

The following examples are intended to illustrate, but not limit, this invention.

EXAMPLE 1

Demonstration of Ternary Complex Formation

This example demonstrates that the composition of the present invention comprises a ternary complex formed from an iron salt and the b) and c) ligands defined herein.

The formation of ferric ion ternary complexes have been determined by redox potential measurements of solutions of ferrous ion, ferric ion and mixtures of the b) and c) ligands. Four ligand solutions were prepared, each containing a ferric ion salt (2 mmol/l) and a ferrous ion salt (2 mmol/l). Solution 1 contained 2-pyridinecarboxylic acid (50 mmol/l) as the only ligand. Solution 2 contained nitrilotriacetic acid (5 mmol/l) as the only ligand. Solutions 3 and 4 contained 2-pyridinecarboxylic acid (50 mmol/l) and nitrilotriacetic acid (2 and 4 mmol/l, respectively).

Figure 2:
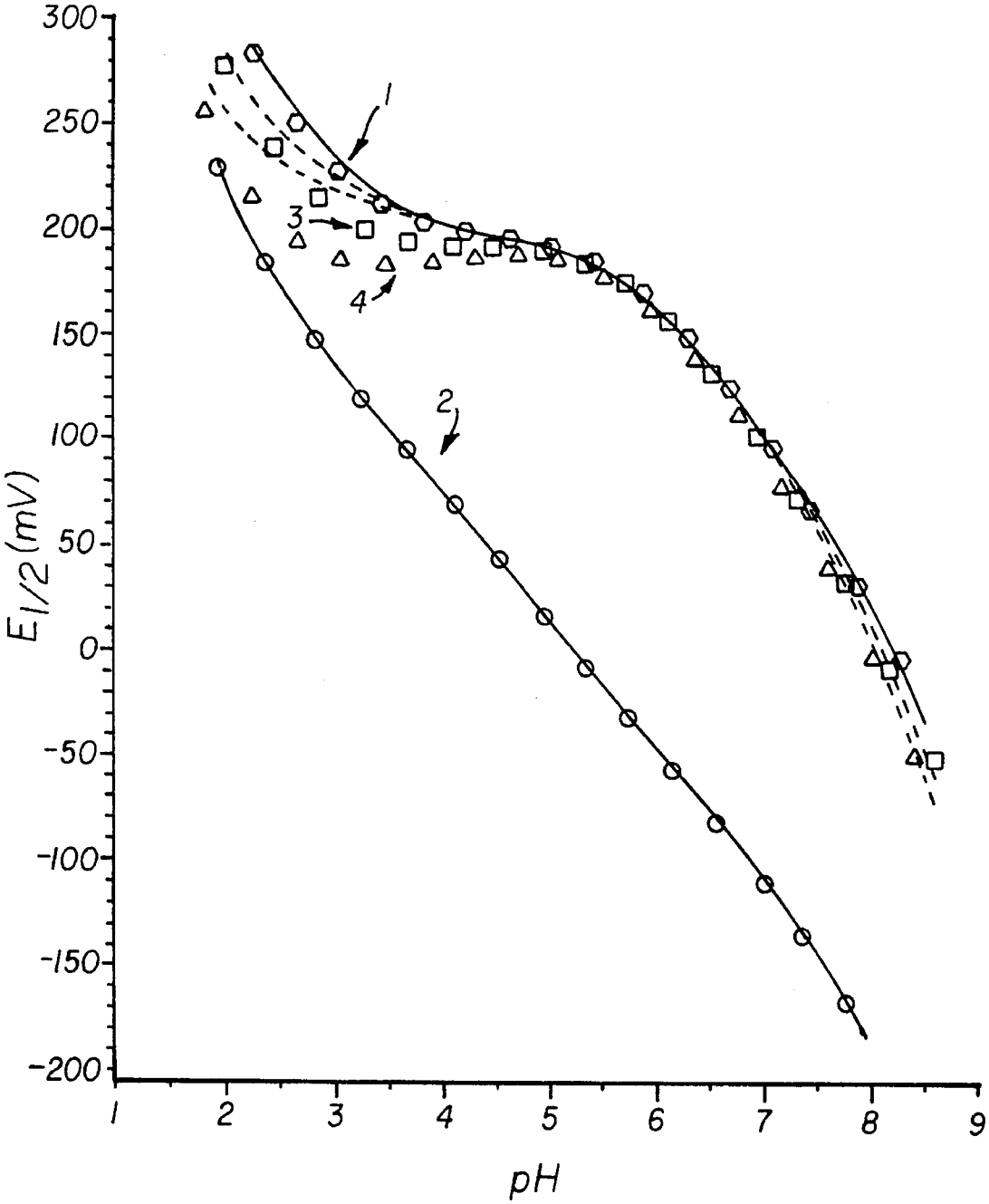

The resulting potentials ($E_{1/2}$ versus a saturated calomel electrode) of each solution were plotted as a function of solution pH, as shown by the symbols in FIGS. 1 and 2. The numbered lines in the FIGURES correspond to the calculated potentials for each of the ligand solutions. It is evident that Solutions 3 and 4, containing both ligands, had more negative potentials than Solution 1, but not as negative as Solution 2. That a ternary complex was formed is evidenced by the fact that the solid lines in FIG. 1, which are calculated potentials based on formation of such as complex, explain the measured potentials observed in Solutions 2 and 3. Without considering such a complex, the potentials for Solutions 2 and 3 cannot be explained, as shown by the dotted lines in FIG. 2. The potentials were calculated with the assumption that no ferric ion ternary complex has formed, but only separate binary complexes of each ligand with ferric ion, which is adequate to explain the potentials of Solutions 1 and 2.

Once the formation constant of the ternary complex was obtained by this analysis, the percentage of total ferric ion salt in the ternary complex was calculated for various concentrations of each ligand at different solution pH values. At pH 4, the optimum mol ratio of ligands and iron ion for this ligand combination, was a ratio of b) ligand:c) ligand:iron of 1.2:1.3:1. The ternary complex comprised 83% of the total ferric ion in the solution under those conditions.

EXAMPLES 2–17

Various Bleaching & Bleach/Fixing Compositions

These examples demonstrate the preparation of several compositions of the present invention, as well as several comparative bleach or bleach/fixing compositions used in later examples.

For all compositions, the iron to ligand mol ratios were for iron:b) ligand:c) ligand.

A Control A composition was prepared by combining water (4 liters) with potassium bromide (280 g), glacial acetic acid (240.2 g) nitrilotriacetic acid (183.49 g) and sufficient 45% (w/w) aqueous potassium hydroxide to raise the pH to 5. Ferric nitrate nonahydrate (323.2 g) was added, and the resulting solution was diluted to 7 liters with water. The pH was adjusted to 5 with solid potassium carbonate, and the solution was then diluted with water to 8 liters. The iron to ligand ratio was 1:1.2:0.

The Example 2 composition was prepared similarly to Control A except that 2,6-pyridinecarboxylic acid (133.7 g predissolved in 2 liters of water and pH adjusted to 5) was added immediately after addition of the ferric ion salt. After adjusting the pH to 5 with potassium carbonate, sufficient water was added to provide 8 liters of solution. The iron to ligand ratio was 1:1.2:1.

A Control B composition was prepared like Control A except that the dipotassium salt of methyliminodiacetic acid (687.11 g of a 52% w/w solution) was used in place of nitriloacetic acid. The iron to ligand ratio was 1:2:0.

The Example 3 composition was prepared similarly to Control A except that the dipotassium salt of methyliminodiacetic acid (687.11 g of 52% w/w solution) was used in place of nitrilotriacetic acid and 2-pyridinecarboxylic acid (98.49 g) was added immediately after the addition of ferric ion salt. The iron to ligand ratio was 1:2:1.

The Example 4 composition was prepared by combining water (4 liters) with potassium bromide (446.93 g), glacial acetic acid (240.2 nitrilotriacetic acid (305.82 g) and sufficient 45% (w/w) aqueous potassium hydroxide to raise the pH to 5. Ferric nitrate nonahydrate (323.2 g) was added, followed by 2-pyridinecarboxylic acid (98.49 g), and the resulting solution was diluted to 7 liters with water. After the pH was adjusted to 4 with solid potassium carbonate, the solution was diluted with water to 8 liters. The iron to ligand ratio was 1:2:1.

The Example 5 composition was prepared similarly to Example 4 except that equimolar potassium chloride (280 g) was substituted for potassium bromide. The iron to ligand ratio was 1:2:1.

The Example 6 composition was prepared by combining water (4 liters) with potassium bromide (446.93 g), glacial acetic acid (240.2 g), citric acid (307.41 g) and sufficient 45% (w/w) aqueous potassium hydroxide to raise the pH to 5. Ferric nitrate nonahydrate (323.2 g) was added, followed by 2-pyridinecarboxylic acid (98.49 g), and the resulting solution was diluted to 7 liters with water. After the pH was adjusted to 4 with solid potassium carbonate, the solution was diluted with water to 8 liters. The iron to ligand ratio was 1:2:2.

The Example 7 composition was prepared similarly to Example 6 except that equimolar potassium chloride (280 g) was used in place of potassium bromide. The iron to ligand ratio was 1:2:2.

A Control C composition was prepared by mixing ferric citrate stock solution [50 ml, containing ferric nitrate (0.25 mol/l), citric acid (0.5 mol/l) acetic acid (0.5 mol/l) and sufficient potassium hyroxide to adjust the pH to 5.0], potassium bromide (3.5 g) and 2-pyridinecarboxylic acid (0.0831 g). The resulting solution was adjusted to pH 5 with potassium carbonate, and the volume was adjusted to 100 ml with distilled water. The bleaching solution was tested one day after preparation to assure that the ferric complexes had equilibrated. This produced a bleaching agent having the iron to ligand ratio of 1:2:0.054, which is the same ratio described in Japanese Kokai 50-26542 (noted above).

The Example 8 composition was prepared similarly to Control C except that it contained 0.9233 g of 2-pyridinecarboxylic acid. The bleaching agent therefore had an iron to ligand ratio of 1:2:0.6.

The Example 9 composition was prepared similarly to Control C except that it contained 1.5389 g of 2-pyridinecarboxylic acid. The bleaching agent therefore had an iron to ligand ratio of 1:2:1.

The Example 10 composition was prepared similarly to Control C except that it contained 3.0778 g of 2-pyridinecarboxylic acid. The bleaching agent therefore had an iron to ligand ratio of 1:2:2.

A Control D composition was prepared by mixing water (4 liters) with potassium bromide (446.93 g), glacial acetic acid (240.2 g), 1,3-propylenediaminetetraacetic acid (269.52 g) and sufficient 45% (w/w) aqueous potassium hydroxide to raise the pH to 4. Ferric nitrate nonahydrate (323.2 g) was added, and the solution was diluted with water to 7 liters. After adjustment to pH 5 with solid potassium carbonate, the solution was diluted to 8 liters with water. The iron to ligand ratio was 1:1.1:0.

A Control E composition was prepared similarly to the Control D composition except that equimolar potassium chloride (280 g) was used in place of potassium bromide. The iron to ligand ratio was 1:1.1:0.

The Example 11 composition was prepared by mixing water (4 liters) with potassium bromide (446.93 g), glacial acetic acid (240.2 g), nitrilotriacetic acid (305.82 g) and sufficient 45% (w/w) aqueous potassium hydroxide to adjust the pH to 4. Ferric nitrate nonahydrate (323.2 g) was added, followed by 2-pyridinecarboxylic acid (98.49 g), and the solution was diluted with water to 7 liters. After adjustment to pH 4 with solid potassium carbonate, the solution was diluted to 8 liters with water. The iron to ligand ratio was 1:2:1.

A Control F composition was prepared similarly to Example 11 except that glacial acetic acid was omitted. The iron to ligand ratio was 1:2:1.

A Control G composition was prepared by mixing potassium bromide (0.875 g) with a solution (5 ml) of ferric nitrate (0.6 mol/l) and potassium acetate (2.5 mol), and a solution (5 ml) of ethylenediaminedisuccinic acid (0.63 mol/l) which had been adjusted to pH 5 with 45% aqueous potassium hydroxide. Water was then added to 25 ml, and the pH was adjusted to 4 with fewer than 5 drops of concentrated sulfuric acid. The iron to ligand ratio was 1:1.05:0.

A Control H composition was prepared similarly to the Control F composition except that the volume of diluting water was reduced to allow for the addition of a solution (1 ml) of 2-pyridinecarboxylic acid (1.2 mol/l, which had been adjusted to pH 4 with aqueous potassium hydroxide) after addition of the b) ligand. The iron to ligand ratio was 1:1.05:0.4.

The Example 12 composition was prepared similarly to the Control G composition except that the volume of diluting water was reduced to allow for the addition of a solution (1.5 ml) of 2-pyridinecarboxylic acid (1.2 mol/l, which had been adjusted to pH 4 with aqueous potassium hydroxide) after addition of the b) ligand. The iron to ligand ratio was 1:1.05:0.6.

The Example 13 composition was prepared similarly to the Control G composition except that the volume of diluting water was reduced to allow for the addition of a solution (2.5 ml) of 2-pyridinecarboxylic acid (1.2 mol/l, which had been adjusted to pH 4 with aqueous potassium hydroxide) after addition of the b) ligand. The iron to ligand ratio was 1:1.05:1.

A Control I composition was prepared similarly to the Control G composition except that solid 2,6-pyridinedicarboxylic acid (0.2016 g) was added after addition of the b) ligand. The iron to ligand ratio was 1:1.05:0.4.

The Example 14 was prepared similarly to the Control G composition except that solid 2,6-pyridinedicarboxylic acid (0.3521 g) was added after addition of the b) ligand. The iron to ligand ratio was 1:1.05:0.7.

The Example 15 composition was prepared similarly to the Control G composition except that solid 2,6-pyridinedicarboxylic acid (0.5025 g) was added after addition of the b) ligand. The iron to ligand ratio was 1:1.05:1.

A Control J composition was prepared by mixing ferric nitrate nonahydrate (0.025 mol/l), ammonium thiosulfate (0.2 mol/l), ammonium sulfite (0.018 mol/l), ammonium nitrate (0.96 mol/l), acetic acid (0.33 mol/l), and nitrilotriacetic acid (0.0275 mol/l). The solution pH was adjusted to either pH 5 or 6 using acetic acid or ammonium hydroxide (see Example 23 below). The iron to ligand ratio was 1:1.1:0.

A Control K composition was prepared similarly to Control J except that the amount of nitrilotriacetic acid was 0.055 mol/l. The composition was used at two different pH values (see Example 23 below). The iron to ligand ratio was 1:2.2:0.

The Example 16 composition was prepared similarly to Control J except that the amount of nitrilotriacetic acid was 0.03 mol/l, and 2-pyridinecarboxylic acid (0.0315 mol/l) was added after the addition of the b) ligand. The iron to ligand ratio was 1:1.2:1.3.

The Example 17 composition was prepared similarly to Example 16 except that 2,6-pyridinedicarboxylic acid (0.0275 mol/l) was added after the addition of the b) ligand. The iron to ligand ratio was 1:1.2:1.1.

EXAMPLE 18

Optimization Of Bleaching Compositions

This example demonstrates the use of several compositions of this invention to bleach imagewise exposed and developed color photographic elements. It also compares the use of those compositions to the use of several Control compositions for bleaching.

Samples (35 mm×304.8 mm each) of KODACOLOR GOLD ULTRA™ 400 speed color film were given a flash exposure on a conventional 1B sensitometer (1/100 second, 3000 K, Daylight Va filter). The exposed samples were then developed and fixed (but not bleached) at 37.7° C. using conventional color negative processing solutions (see, for example *Brit. J. Photo.*, page 196, 1988) using the following protocol:

| | |
|---|---|
| 3 minutes, 15 seconds | Developer bath, |
| 1 minute | Stop bath, |
| 1 minute | Water wash, |
| 4 minutes | Fixing bath, |
| 3 minutes | Water wash, and |
| 1 minute | Water rinse. |

The film samples were then air dried. To measure a rate of bleaching, a 1.3 $cm^2$ round piece was removed from each sample and placed in a flow cell. This cell, 1 cm×1 cm×2 cm, was constructed to hold the round piece in an ultraviolet light/visible diode array spectrophotometer, enabling the visible absorption of the round piece to be measured while a processing solution was circulated over the face of the round piece. Both the processing solution (20 ml) and the flow cell were held at a constant temperature of 25° C. One hundred absorbance measurements (an average of the absorbances at 814, 816, 818, and 820 nm) were collected at 5-second intervals over a 500-second period of time. The absorbance as a function of time was plotted, and the time required for 50% bleaching was determined graphically. Control experiments indicated that this flow cell method is an excellent predictor of bleaching rates in a standard process run at 37.7° C.

The resulting bleaching rates at pH 5 for the bleaching compositions using the noted bleaching protocol are provided in Table I below. The compositions contain a constant iron to b) ligand ratio of 1:2, and variable amounts of c) ligand. Control composition C is representative of bleaching compositions described in Japanese Kokai 50-26542 (noted above) having an iron to ligand ratio of 1:2:0.054. It is apparent that the compositions of the present invention (Examples 8–10) provide markedly superior bleaching rates.

TABLE I

| Composition | Mol Ratio of Iron:b) Ligand:c) Ligand | Bleaching Rate |
|---|---|---|
| Control C | 1:2:0.054 | about 10% after 500 seconds |
| Example 8 | 1:2:0.6 | 50% bleaching after 274 seconds |
| Example 9 | 1:2:1 | 50% bleaching after 149 seconds |
| Example 10 | 1:2:2 | 50% bleaching after 87 seconds |

EXAMPLE 19

Rapid Bleaching Using Invention

This example compares the use of two compositions of this invention with the use of two Control compositions for rapid bleaching of a color photographic film.

Samples (35 mm×304.8 mm each) of KODACOLOR GOLD PLUS™ 100 speed film were given a stepwise exposure on a conventional 1B sensitometer (1/25 second, 3000 K, Daylight Va filter, 21 step 0–4 density chart). The exposed elements were processed at 37.7° C. using standard color negative processing solutions (see Example 18), except for the bleaching solution, using the following protocol:

| | |
|---|---|
| 3 minutes, 15 seconds | Developer bath, |
| 1 minute | Stop bath, |
| 1 minute | Water wash, |
| various times | Bleaching bath, |
| 3 minutes | Water wash, |
| 4 minutes | Fixing bath, |
| 3 minutes | Water wash, and |
| 1 minute | Water rinse. |

Bleach times of 0, 15, 30, 45, 60, 75, 90, 120, 180 and 240 seconds were employed. The processed film samples were air dried, and the D-max residual silver (an average of values at steps 2, 3 and 4) was determined for each sample by conventional X-ray fluorescence spectroscopy. Data for residual silver as a function of bleaching time are provided in Table II below. It is apparent that the compositions of the present invention provide significantly improved bleaching over the Control compositions which contain only binary complexes [lacking the c) ligand]. The compositions of this invention tested in this example are biodegradable.

TABLE II

| Bleaching Time | Residual Silver (g/m²) | | | |
|---|---|---|---|---|
| (Seconds) | Control A | Example 2 | Control B | Example 3 |
| 0 | 1.079 | 1.083 | 1.114 | 1.116 |
| 15 | 1.048 | 0.649 | 0.839 | 0.672 |
| 30 | 1.011 | 0.404 | 0.624 | 0.479 |
| 45 | 0.974 | 0.270 | 0.475 | 0.313 |
| 60 | 0.901 | 0.137 | 0.355 | 0.212 |
| 75 | 0.886 | 0.088 | 0.283 | 0.102 |
| 90 | 0.850 | 0.069 | 0.228 | 0.084 |
| 120 | 0.779 | 0.056 | 0.150 | 0.064 |
| 180 | 0.682 | 0.060 | 0.100 | 0.047 |
| 240 | 0.564 | 0.048 | 0.077 | 0.057 |

EXAMPLE 20

Use of Rehalogenating Bleaching Compositions of This Invention

This example compares the use of rehalogenating bleaching compositions of the present invention to compositions outside the scope of this invention.

Samples (35 mm×304.8 mm each) of KODACOLOR GOLD ULTRA™ 400 speed film and KODAK DURACLEAR™ film were imagewise exposed using a conventional 1B sensitometer (3000K, Daylight Va filter, 21 step 0–4 density chart, 1/100 second for the KODACOLOR GOLD ULTRA™ film and ½ second for the KODAK DURACLEAR™ film). The exposed samples were processed at 37.7° C. using conventional color negative processing solutions (see Example 18 above) using the protocol described in Example 19 above.

Bleach times of 0, 15, 30, 45, 60, 75, 90, 120, 180 and 240 seconds were employed. The processed film samples were air dried, and the D-max residual silver (an average of values at steps 2, 3 and 4) was determined for each sample by conventional X-ray fluorescence spectroscopy. Data for residual silver as a function of time are provided in Tables III and IV below for each bleaching solution for the two types of film, respectively.

In contrast to the bleaching solutions containing 1,3-propylenediaminetetraacetic acid, where substitution of equimolar chloride for bromide is accompanied by a large loss in bleaching rate (Control E), the compositions of the present invention (Examples 5 and 7) containing chloride as a rehalogenating agent showed little loss in bleaching rate compared to those containing bromide. As a result, the present invention provides a practical means of rehalogenating silver to silver chloride with a ferric chelate bleaching solution containing only biodegradable ligands. This example also illustrates the use of the invention with a silver chloride photographic element (KODAK DURACLEAR film, Table IV).

TABLE III

| Bleaching | Residual Silver (g/m²) | | | | | |
|---|---|---|---|---|---|---|
| Time (Seconds) | Example 4 | Example 5 | Example 6 | Example 7 | Control D | Control E |
| 0 | 1.129 | 1.117 | 1.088 | 1.116 | 1.128 | 1.134 |
| 15 | 0.632 | 0.833 | 0.724 | 0.814 | 0.570 | 1.108 |
| 30 | 0.471 | 0.683 | 0.614 | 0.669 | 0.325 | 1.056 |

TABLE III-continued

| Bleaching | Residual Silver (g/m²) | | | | | |
|---|---|---|---|---|---|---|
| Time (Seconds) | Example 4 | Example 5 | Example 6 | Example 7 | Control D | Control E |
| 45 | 0.279 | 0.560 | 0.461 | 0.567 | 0.130 | 0.994 |
| 60 | 0.198 | 0.475 | 0.420 | 0.499 | 0.069 | 0.905 |
| 90 | 0.066 | 0.347 | 0.261 | 0.336 | 0.050 | 0.845 |
| 120 | 0.044 | 0.207 | 0.172 | 0.233 | 0.036 | 0.734 |
| 180 | 0.037 | 0.061 | 0.031 | 0.033 | 0.032 | 0.573 |
| 240 | 0.044 | 0.046 | 0.048 | 0.013 | 0.035 | 0.480 |

TABLE IV

| Bleaching | Residual Silver (g/m²) | | | | | |
|---|---|---|---|---|---|---|
| Time (Seconds) | Example 4 | Example 5 | Example 6 | Example 7 | Control D | Control E |
| 0 | 1.733 | 1.899 | 1.743 | 1.862 | 1.889 | 1.897 |
| 15 | 1.104 | 1.499 | 1.400 | 1.443 | 0.945 | 1.633 |
| 30 | 0.695 | 1.156 | 1.188 | 1.230 | 0.401 | 1.482 |
| 45 | 0.424 | 0.894 | 0.979 | 0.998 | 0.076 | 1.232 |
| 60 | 0.239 | 0.705 | 0.730 | 0.807 | 0.047 | 1.042 |
| 90 | 0.066 | 0.380 | 0.492 | 0.540 | 0.048 | 0.736 |
| 120 | 0.060 | 0.084 | 0.270 | 0.275 | 0.037 | 0.467 |
| 180 | 0.069 | 0.046 | 0.081 | 0.043 | 0.038 | 0.111 |
| 240 | 0.065 | 0.052 | 0.067 | 0.037 | 0.065 | 0.042 |

EXAMPLE 21

Use Of Buffer In Composition of the Invention

This example demonstrates the need for an organic acid to buffer the composition of this invention, which organic acid is a compound other than the b) or c) ligand.

Samples of KODAK EKTAR™ 100 speed film was stepwise exposed using a conventional 1B sensitometer (1/100 second, 3000K, Daylight Va filter, 21 step 0–4 density chart). The exposed samples were processed at 37.7° C. using conventional color negative processing solutions using the following three processing protocols:

| Protocol A: | |
|---|---|
| 3 minutes, 15 seconds | Developer bath, |
| 1 minute | Stop bath, |
| 1 minute | Water wash, |
| 4 minutes | Bleaching bath (Example 15), |
| 3 minutes | Water wash, |
| 4 minutes | Fixing bath, |
| 3 minutes | Water wash, and |
| 1 minute | Water rinse. |

Protocol B

Same as Protocol A except that the Stop bath and Water wash steps following development were omitted.

Protocol C

Same as Protocol A except that the Stop bath and Water wash steps following development were omitted and the Control F composition was substituted for the Example 11 composition as the bleaching solution.

Table V below provides data of blue and green densities for each processing protocol. It is evident that Protocol C, using Control F composition, without acetic acid, gave substantially higher green and blue densities and is thus less desirable than the use of the Example 11 composition as a bleach solution in both Protocols A and B.

TABLE V

| Protocol | Blue Dmin | Green Dmin |
|---|---|---|
| A (Invention) | 0.85 | 0.89 |
| B (Invention) | 0.86 | 0.90 |
| C (Control) | 1.01 | 0.94 |

EXAMPLE 22

Additional Comparisons

In this example, a flow cell (see Example 18) was used to measure bleaching rates obtained with certain bleaching compositions.

Samples (35 mm×304.8 mm each) of KODACOLOR GOLD ULTRA™ 400 speed color film were given a flash exposure on a conventional 1B sensitometer (1/100 second, 3000 K, Daylight Va filter). The exposed samples were then developed and fixed (but not bleached) at 37.7° C.

The film samples were then air dried and subjected to the preparation and testing of round pieces of each sample in the flow cell.

The results of bleaching rates at pH 4 for various compositions are provided in Table VI below. It is apparent that the compositions of the present invention provided significant improvement in bleaching rate over the Control compositions. The Example 12–15 compositions are especially desirable because the ligands used to form the complex are biodegradable and inexpensive. While the binary complex of ferric ion with ethylenediaminedisuccinic acid is a relatively weak bleaching agent, the ternary iron complexes containing additionally the c) ligands are more powerful bleaching agents.

TABLE VI

| Composition | Molar Ratio of Iron:b) Ligand:c) Ligand | Bleaching Rate |
|---|---|---|
| Control G | 1:1.05:0 | 47% bleaching after 500 seconds |
| Control H | 1:1.05:0.4 | 90% bleaching after 265 seconds |
| Example 12 | 1:1.05:0.6 | 90% bleaching after 215 seconds |
| Example 13 | 1:1.05:1 | 90% bleaching after 175 seconds |
| Control I | 1:1.05:0.4 | 90% bleaching after 185 seconds |
| Example 14 | 1:1.05:0.7 | 90% bleaching after 135 seconds |
| Example 15 | 1:1.05:1 | 90% bleaching after 110 seconds |

EXAMPLE 23

Use of Bleach/Fixing Compositions of the Invention

This example demonstrates the practice of the present invention to bleach/fix imagewise exposed and developed color photographic elements, using the flow cell procedure described above.

A single emulsion layer film, containing a sensitized silver bromide emulsion (1.08 g/m$^2$) and a single yellow dye-forming color coupler, was tested in the flow cell apparatus. Samples of the film were bleach/fixed using various compositions in a flow cell wherein each composition was rapidly pumped through the cell. Image density was monitored in the cell as a function of time at 810 nm to measure the oxidation and dissolution of silver formed in the film by a flash exposure to a 3000K light source for 0.5 second, then processed using the following protocol:

| | |
|---|---|
| 3 minutes | Color development, |
| 1 minute | Stop bath (3% acetic acid), |
| 1 minute | Water wash, and |
| 1 minute | Stabilization bath. |

Bleach/fixing was accomplished using the compositions identified in Table VII below at two different pH values. The silver density loss was used to calculate the time for half of the density to change, representing half of the silver removed in the bleach/fixing step. The data in Table VII indicates that the compositions of this invention containing ternary complexes provided faster bleach/fixing than the compositions containing only a binary complex of ferric ion and a single ligand (Controls J and K), especially at the lower pH.

TABLE VII

| Composition | Time (seconds) to Remove 50% of Silver Density | |
|---|---|---|
| | pH 5 | pH 6 |
| Control J | 96 | 124 |
| Control K | 112 | 125 |
| Example 16 | 84 | 135 |
| Example 17 | 73 | 98 |

The invention has been described in detail with particular reference to preferred embodiments thereof, but it will be understood that variations and modifications can be effected within the spirit and scope of the invention.

We claim:

1. An aqueous composition for bleaching or bleach/fixing an imagewise exposed and developed silver halide color photographic element comprising a ternary complex formed from:

a) an iron salt, b) a polycarboxylate or aminocarboxylate ligand, and c) a carboxylate ligand containing an aromatic nitrogen heterocycle, said c) ligand having either structure (VIII):

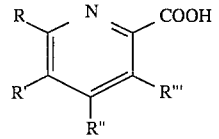

or (IX):

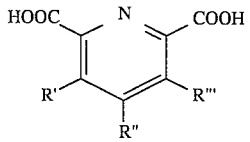

wherein R, R', R'' and R''' are independently hydrogen, an alkyl group of 1 to 5 carbon atoms, an aryl group of 6 to 10 carbon atoms in the aromatic nucleus, a cycloalkyl group of 5 to 10 carbon atoms in the ring, hydroxy, nitro, sulfo, amino, phospho, carboxy, sulfamoyl, sulfonamido or halo, or any two of R, R', R" and R'" can comprise the carbon atoms necessary to form a 5 to 7-membered ring fused with the pyridinyl nucleus, or being a salt of said compound of structure VIII or IX, wherein the mol ratio of b) ligand to iron in said complex is at least 1:1, and the mol ratio of c) ligand to iron in said complex is at least 0.6:1, and said aqueous composition having a pH of from about 3 to about 7 provided at least in part by a buffering compound other than a), b) or c).

2. The composition of claim 1 wherein the mol ratio of b) ligand to iron is from 1:1 to 5:1, and the mol ratio of c) ligand to iron is from 0.6:1 to 4:1.

3. The composition of claim 1 wherein said iron salt is ferric nitrate nonahydrate, ferric oxide, ferric sulfate, ferric ammonium sulfate or ferric chloride and is present in an amount of from about 0.0005 to about 0.5 mol/l.

4. The composition of claim 1 wherein either or both of said b) ligand or c) ligand are biodegradable.

5. The composition of claim 1 wherein said b) ligand is a hydroxycarboxylic acid, an alkylenediaminetetracarboxylic acid having a tertiary nitrogen atom, an alkylenediaminetetracarboxylic acid having a secondary nitrogen atom, an iminopolyacetic acid, a substituted ethyliminopolycarboxylic acid, an aminopolycarboxylic acid having an aliphatic dibasic acid group or an amino ligand having an aromatic or heterocyclic substituent.

6. The composition of claim 5 wherein said b) ligand has one of the following structures:

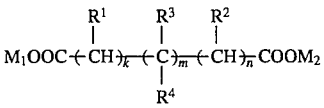

(I)

wherein $R^1$ and $R^2$ are independently hydrogen or hydroxy, $R^3$ and $R^4$ are independently hydrogen, hydroxy or carboxy, $M_1$ and $M_2$ are independently hydrogen or a monovalent cation, k, m and n are 0 or 1, provided that at least one of k, m and n is 1, and further provided that said compound (I) has at least one hydroxy group,

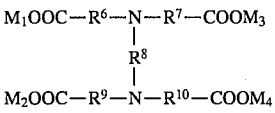

(II)

wherein $R^6$, $R^7$, $R^8$, $R^9$ and $R^{10}$ are independently an alkylene group of 1 to 6 carbon atoms, and $M_1$, $M_2$, $M_3$ and $M_4$ are independently hydrogen or a monovalent cation,

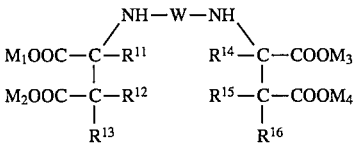

(III)

wherein $R^{11}$, $R^{12}$, $R^{13}$, $R^{14}$, $R^{15}$ and $R^{16}$ are independently hydrogen, hydroxy, an alkyl group of 1 to 5 carbon atoms, a cycloalkyl group of 5 to 10 carbon atoms in the ring, or an aryl group having 6 to 10 carbon atoms in the aromatic nucleus, $M_1$, $M_2$, $M_3$ and $M_4$ are as defined above, and W is a covalent bond or a divalent aliphatic linking group,

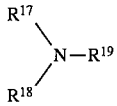

(IV)

wherein at least two of $R^{17}$, $R^{18}$ and $R^{19}$ are carboxymethyl, and the third group is hydrogen, an alkyl group of 1 to 5 carbon atoms, hydroxyethyl or carboxymethyl,

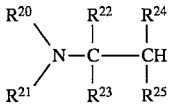

(V)

wherein $R^{20}$ and $R^{21}$ are independently carboxymethyl or 2-carboxyethyl, and $R^{22}$, $R^{23}$, $R^{24}$ and $R^{25}$ are independently hydrogen, an alkyl group of 1 to 5 carbon atoms, hydroxy, carboxy or carboxymethyl, provided that only one of $R^{22}$, $R^{23}$, $R^{24}$ and $R^{25}$ is carboxy or carboxymethyl,

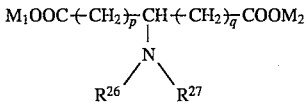

(VI)

wherein $R^{26}$ and $R^{27}$ are independently hydrogen, an alkyl group of 1 to 5 carbon atoms, hydroxyethyl, carboxymethyl or 2-carboxyethyl, $M_1$ and $M_2$ are as defined above, and p and q are independently 0, 1 or 2 provided that the sum of p and q does not exceed 2, or

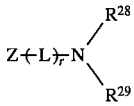

(VII)

wherein

Z represents an aryl group of 6 to 10 carbon atoms in the nucleus or a heterocycle group having 5 to 7 carbon, nitrogen, sulfur and oxygen atoms in the nucleus, L is a divalent aliphatic linking group, $R^{28}$ and $R^{29}$ are independently hydrogen, an alkyl group of 1 to 5 carbon atoms, a carboxyalkyl group of 2 to 4 carbon atoms or hydroxy-substituted carboxyalkyl group of 2 to 4 carbon atoms, and r is 0 or 1.

7. The composition of claim 6 wherein said ligand b) is that having either structure I, III or IV.

8. The composition of claim 6 wherein said b) ligand is citric acid, tartaric acid, iminodiacetic acid, methyliminodiacetic acid, nitrilotriacetic acid, b-alaninediacetic acid, alaninediacetic acid, ethylenediaminedisuccinic acid, ethylenediaminediacetic acid, alaninedipropionic acid, isoserinediacetic acid, serinediacetic acid, iminodisuccinic acid, aspartic acid monoacetic acid, aspartic acid diacetic acid, aspartic acid dipropionic acid, 2-hydroxybenzyliminodiacetic acid or 2-pyridylmethyliminodiacetic acid.

9. The composition of claim 1 wherein said c) ligand is 2-pyridinecarboxylic acid, 2,6-pyridinedicarboxylic acid or a salt thereof.

10. The composition of claim 1 wherein said buffering compound is an organic acid having a pKa of from about 1.5 to about 6.5 and which is present in an amount of from about 0.05 to about 3 mol/l.

11. The composition of claim 1 wherein said iron salt is present in an amount of from about 0.001 to about 0.05 mol/l, the mol ratio of said b) ligand to iron in said complex is from 1:1 to 3.5:1, and said buffering compound is a carboxylic acid buffer.

12. The composition of claim 1 further comprising a rehalogenating agent.

13. The composition of claim 12 wherein said rehalogenating agent is present in an amount of from about 0.05 to about 2 mol/l, said iron salt ms present in an amount of from about 0.01 to about 0.5 mol/l, and the mol ratio of said b) ligand to iron in said complex is from 1:1 to 3.5:1.

14. The composition of claim 13 wherein said rehalogenating agent is chloride, and acid buffering compound is a carboxylic acid buffer.

15. The composition of claim 1 further comprising a fixing agent.

16. The composition of claim 15 wherein said iron salt is present in an amount of from about 0.01 to about 0.5 mol/l, and the mol ratio of said b) ligand to iron in said complex is from 1:1 to 3.5:1.

17. The composition of claim 15 wherein said fixing agent is a thiosulfate, and said buffering compound is a carboxylic acid buffer.

18. An aqueous composition for bleaching or bleach/fixing an imagewise exposed and developed silver halide photographic element comprising:

1) a ternary complex formed from:
   a) an iron salt,
   b) citric acid or a salt thereof, and
   c) 2-pyridinecarboxylic acid or 2,6-pyridinedicarboxylic acid,
   wherein the mol ratio of b) ligand to iron in said complex is from 1:1 to 3.5:1, and the mol ratio of c) ligand to iron in said complex is from 0.6:1 to 4:1,
2) acetic acid or glycolic acid buffer, and
3) one or more of the components selected from the group consisting of:
   a peracid bleaching agent,
   a rehalogenating agent,
   a fixing agent,
   a defoaming agent,
   a chlorine scavenger,
   a bleach accelerator,
   a calcium chelating agent,
   a corrosion inhibitor, and
   an optical whitening agent.

19. A photographic bleaching or bleach/fixing method comprising processing an imagewise exposed and developed silver halide color photographic element with an aqueous bleaching or bleach/fixing composition comprising a ternary complex formed from:

a) an iron salt, b) a polycarboxylate or aminocarboxylate ligand, and c) a carboxylate ligand containing an aromatic nitrogen heterocycle, said c) ligand having either structure (VIII):

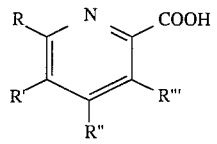

or (IX):

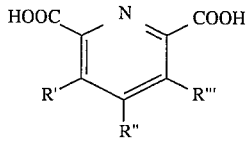

wherein R, R', R'' and R''' are independently hydrogen, an alkyl group of 1 to 5 carbon atoms, an aryl group of 6 to 10 carbon atoms in the aromatic nucleus, a cycloalkyl group of 5 to 10 carbon atoms in the ring, hydroxy, nitro, sulfo, phospho, amino, carboxy, sulfamoyl, sulfonamido or halo, or any two of R, R', R'' and R''' can comprise the carbon atoms necessary to form a 5 to 7-membered ring fused with the pyridinyl nucleus, or being a salt of said compound of structure VIII or IX, wherein the mol ratio of b) ligand to iron in said complex is at least 1:1, and the mol ratio of c) ligand to iron in said complex is at least 0.6:1, and said aqueous composition having a pH of from about 3 to about 7 provided at least in part by a buffering compound other than a), b) or c).

20. The method of claim 19 wherein:

said iron salt is ferric nitrate nonahydrate, ferric sulfate, ferric oxide, ferric ammonium persulfate, ferric chloride or ferric sulfate, and is present in said composition an amount of from about 0.0005 to about 0.5 mol/l, said b) ligand is a hydroxycarboxylic acid, an alkylenediaminetetracarboxylic acid having a tertiary nitrogen atom, an alkylenediaminetetracarboxylic acid having a secondary nitrogen atom, an iminopolyacetic acid, a substituted ethyliminopolycarboxylic acid, an aminopolycarboxylic acid having an aliphatic dibasic acid group or an amino ligand having an aromatic or heterocyclic substituent, said c) ligand is a substituted or unsubstituted 2-pyridinecarboxylic acid or a substituted or unsubstituted 2,6-pyridinedicarboxylic acid, and said buffering compound is an organic acid having a pKa of from about 1.5 to about 6.5 and is present in said composition in an amount of from about 0.05 to about 3 mol/l.

21. The method of claim 19 wherein said composition further comprises a rehalogenating agent in an amount of from about 0.05 to about 2 mol/l.

22. The method of claim 21 wherein said rehalogenating agent is chloride.

23. The method of claim 19 wherein said bleaching composition is a bleach-fix composition comprising a fixing agent.

24. The method of claim 19 wherein:

said b) ligand has one of the following structures:

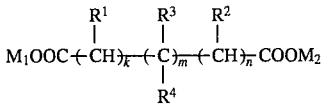

(I)

wherein $R^1$ and $R^2$ are independently hydrogen or hydroxy, $R^3$ and $R^4$ are independently hydrogen, hydroxy or carboxy, $M_1$ and $M_2$ are independently hydrogen or a monovalent cation, k, m and n are 0 or 1, provided that at least one of k, m and n is 1, and further provided that said compound (I) has at least one hydroxy group,

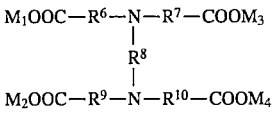

(II)

wherein $R^6$, $R^7$, $R^8$, $R^9$ and $R^{10}$ are independently an alkylene group of 1 to 6 carbon atoms, and $M_1$, $M_2$, $M_3$ and $M_4$ are independently hydrogen or a monovalent cation,

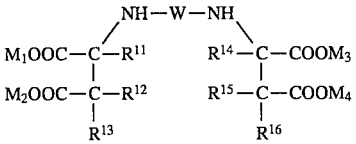

(III)

wherein $R^{11}$, $R^{12}$, $R^{13}$, $R^{14}$, $R^{15}$ and $R^{16}$ are independently hydrogen, hydroxy, an alkyl group of 1 to 5 carbon atoms, a cycloalkyl group of 5 to 10 carbon atoms in the ring, or an aryl group having 6 to 10 carbon atoms in the aromatic nucleus, $M_1$, $M_2$, $M_3$ and $M_4$ are as defined above, and W is a covalent bond or a divalent aliphatic linking group,

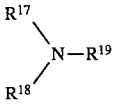

(IV)

wherein at least two of $R^{17}$, $R^{18}$ and $R^{19}$ are carboxymethyl, and the third group is hydrogen, an alkyl group of 1 to 5 carbon atoms, hydroxyethyl or carboxymethyl,

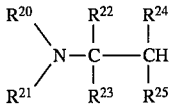

(V)

wherein $R^{20}$ and $R^{21}$ are independently carboxymethyl or 2-carboxyethyl, and $R^{22}$, $R^{23}$, $R^{24}$ and $R^{25}$ are independently hydrogen, an alkyl group of 1 to 5 carbon atoms, hydroxy, carboxy or carboxymethyl, provided that only one of $R^{22}$, $R^{23}$, $R^{24}$ and $R^{25}$ is carboxy or carboxymethyl,

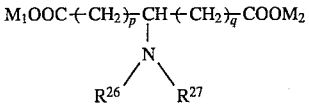

(VI)

wherein $R^{26}$ and $R^{27}$ are independently hydrogen, an alkyl group of 1 to 5 carbon atoms, hydroxyethyl, carboxymethyl or 2-carboxyethyl, $M_1$ and $M_2$ are as defined above, and p and q are independently 0, 1 or 2 provided that the sum of p and q does not exceed 2, or

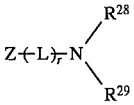

(VII)

wherein

Z represents an aryl of 6 to 10 carbon atoms in the nucleus or a heterocycle having 5 to 7 carbon, nitrogen, sulfur and oxygen atoms in the nucleus, L is a divalent aliphatic linking group, $R^{28}$ and $R^{29}$ are independently hydrogen, an alkyl group of 1 to 5 carbon atoms, a carboxyalkyl group of 2 to 4 carbon atoms or hydroxy-substituted carboxyalkyl group of 2 to 4 carbon atoms, and r is 0 or 1.

* * * * *

UNITED STATES PATENT AND TRADEMARK OFFICE

CERTIFICATE OF CORRECTION

PATENT NO. : 5,582,958
DATED : December 10, 1996
INVENTOR(S) : J M Buchanan, et al It is certified that error appears in the above-indentified patent and that said Letters Patent is hereby corrected as shown below:

Col. 23, line 20 delete [acid] and insert -- said--

Signed and Sealed this

Eighteenth Day of March, 1997

*Attest:*

Bruce Lehman

BRUCE LEHMAN

*Attesting Officer*

*Commissioner of Patents and Trademarks*